United States Patent [19]

Saby

[11] 4,406,918

[45] Sep. 27, 1983

[54] TEMPERED GLASS DIELECTRIC MEMBER FOR AN ELECTRICAL INSULATOR, AND AN INSULATOR USING SAID MEMBER

[75] Inventor: Charles Saby, Saint-Yorre, France

[73] Assignee: Ceraver, Paris, France

[21] Appl. No.: 401,568

[22] Filed: Jul. 26, 1982

[30] Foreign Application Priority Data

Aug. 5, 1981 [FR] France ..... 81 15204

[51] Int. Cl.[3] ..... H01B 17/02; H01B 17/20

[52] U.S. Cl. ..... 174/196; 174/182; 174/212

[58] Field of Search ..... 174/182, 186, 188, 189, 174/194, 195, 196, 202, 206, 210, 212

[56] References Cited

U.S. PATENT DOCUMENTS 2,008,414 7/1935 Fischer ..... 174/196 X

FOREIGN PATENT DOCUMENTS 344487 9/1927 Belgium ..... 174/210

*Primary Examiner*—Laramie E. Askin

*Attorney, Agent, or Firm*—Kenyon & Kenyon

[57] ABSTRACT

The member is in the form of a hollow body having a skirt (2) surmounted by a head (1), the entire body exhibiting circular symmetry about an axis (10). The hollow body has an internal ring (5) at an intermediate level between the head and the skirt. The surface of the internal ring is corrugated as traced by a generator line at a constant angle to said axis and moving around a closed corrugated curve situated in a plane orthogonal to said axis. This arrangement provides resistance to torsion forces without requiring any sharp inside edges that are difficult to manufacture in tempered glass.

7 Claims, 3 Drawing Figures

TEMPERED GLASS DIELECTRIC MEMBER FOR AN ELECTRICAL INSULATOR, AND AN INSULATOR USING SAID MEMBER

The present invention relates to a dielectric member of tempered glass for an electrical insulator. The member is of circular symmetry in the form of a skirt surmounted by a head. The outside of the head is for sealing into some other member, eg. the inside of another dielectric or of a metal cap. It further includes an internal cavity for having a rod or a pin sealed therein.

The invention is particularly concerned with said internal cavity, especially for insulators for use in equipment where the tempered glass dielectric is liable to be subjected to high torsion forces.

BACKGROUND OF THE INVENTION

For this purpose it is already known to provide a ring of anti-rotation teeth inside the internal cavity at an intermediate level between the head and the skirt. These inwardly projecting teeth have sharp edges between generally flat faces, and it will readily be understood that it is difficult to make such teeth in a piece of glass because of there fragility. Further, the smaller the diameter of the ring and the thinner the glass at said intermediate level, the greater the difficulty.

Preferred embodiments of the present invention avoid these drawbacks.

SUMMARY OF THE INVENTION

The present invention provides a tempered glass dielectric member for an electrical insulator, the member being in the form of a hollow body having a skirt surmounted by a head, the entire body exhibiting circular symmetry about an axis; said hollow body having an internal ring at an intermediate level between the head and the skirt, said ring having a corrugated surface traced by a generator line at a constant angle to said axis and moving around a closed corrugated curve situated in a plane orthogonal to said axis.

In a preferred embodiment, the corrugations of the closed curve are substantially sinusoidal. Preferably there is an external ring on the outside of the member at the same level as said internal ring which bulges outwardly to compensate for the reduced thickness of glass in the troughs of the corrugations.

Said exterior ring may itself have teeth.

The corrugations are made with a punch type of tool used inside the the skirt while the glass is still malleable.

The invention also provides an electrical insulator comprising at least one dielectric of the above type whose head is intended to receive a sealed link member on its inside such as a pin or a rod. The sealing is performed by means of a material which fills said head and its internal ring, for example a cement mortar containing glass fibers or a fiber-containing resin.

BRIEF DESCRIPTION OF THE DRAWINGS

An embodiment of the invention is described by way of example with reference to the accompanying drawings, in which.

MORE DETAILED DESCRIPTION

Figure 1:
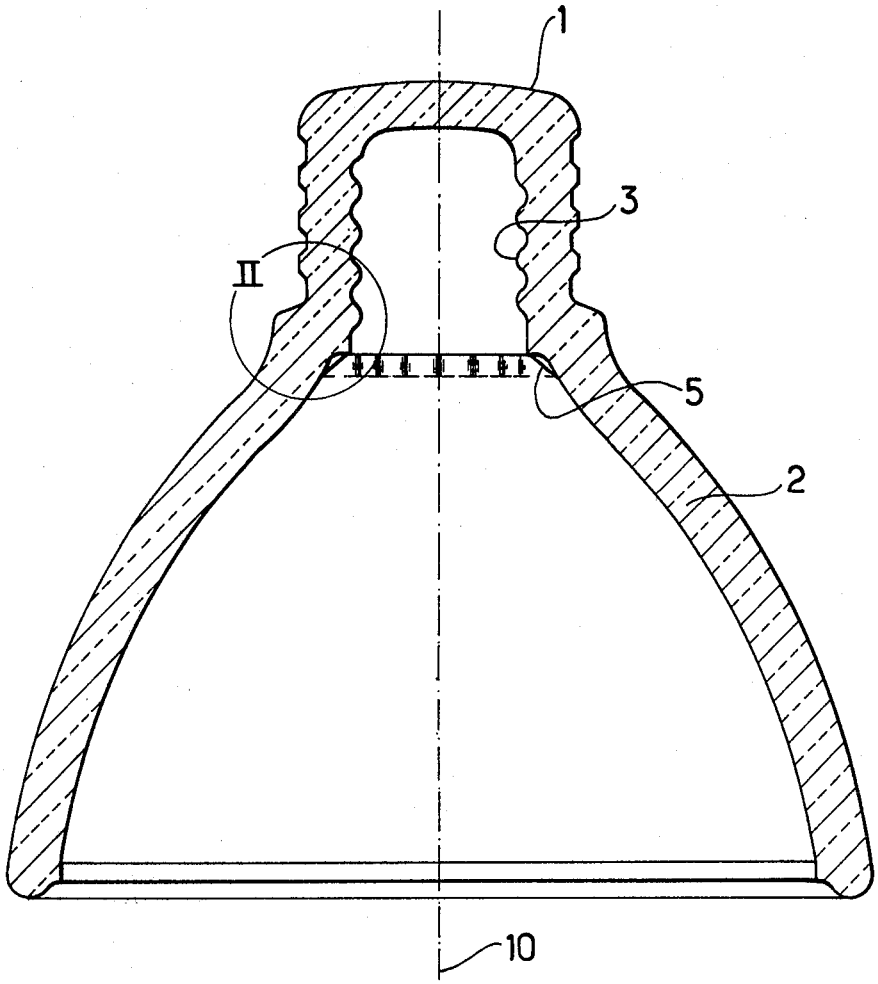
FIG. 1 is a diagrammatic axial section through a dielectric member in accordance with the invention.

FIG. 1 shows a dielectric member in accordance with the invention, comprising a skirt 2 surmounted by a head 1. The member as a whole is symmetrical about an axis 10. An intermediate toothed ring 5 is provided in the cavity at the transition between the skirt 2 and the head 1.

Figure 2:
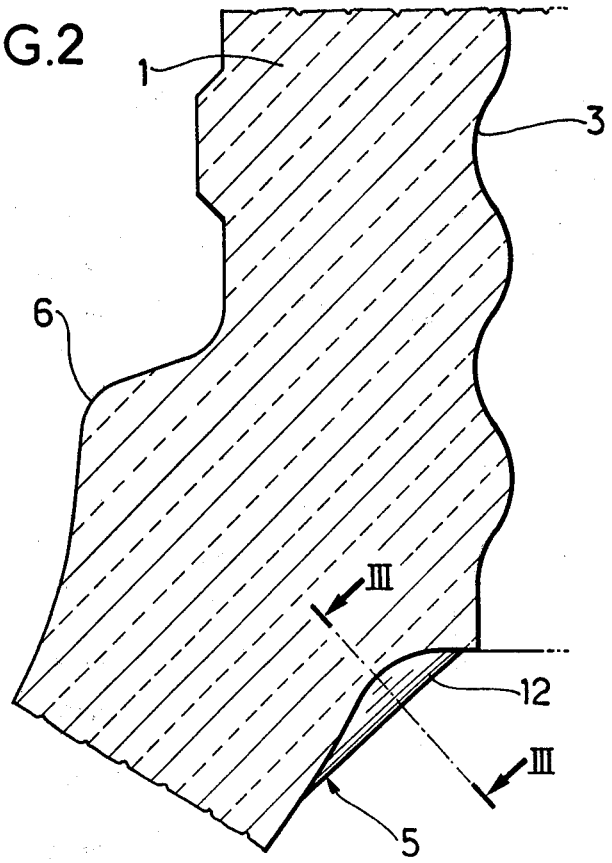
FIG. 2 is a detail II of FIG. 1 on a larger scale.
Figure 3:
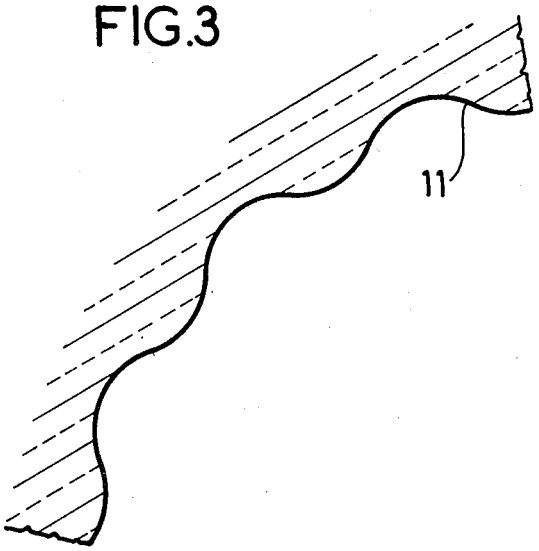
FIG. 3 is a conical section along a line III—III in FIG. 2.

FIGS. 2 and 3 show the shape of the toothed ring 5 more clearly together with an exterior bulge 6 for compensating the reduced thickness of glass in the troughs of the toothed ring 5. The corrugated line 11 in FIG. 3 is obtained by taking a section through a tooth 12 as shown in FIG. 2 and rotating about the axis. In other words the section of FIG. 3 is on a development of a conical surface.

The corrugations are substantially sinusoidal and without sharp angles. They can readily be made without risk of the glass breaking. They may be about 8 mm long, for example, with a depth of about 1.5 mm. Thus a ring with an internal diameter of 38 mm would have a dozen or so teeth.

When the cavity 3 and the ring 5 are filled with sealing material and a torsion force is applied to the head 1, the material is compressed inside the teeth and the sealing material provides increased mechanical shear strength.

To further improve this result, a sealing mortar comprising glass fibers in cement is preferably used, or alternatively a mortar comprising resin and fibers, particularly glass fibers. This avoids possible shear between the sealing mortar in the ring zone and the mortar situated in the rest of the cavity.

I claim:

1. A tempered glass dielectric member for an electrical insulator, the member being in the form of a hollow body having a skirt surmounted by a head, the entire body exhibiting circular symmetry about an axis; said hollow body having an internal ring at an intermediate level between the head and the skirt, said ring having a corrugated surface traced by a generator line at a constant angle to said axis and moving around a closed corrugated curve situated in a plane orthogonal to said axis.

2. A dielectric member according to claim 1, wherein the corrugations of the closed curve are substantially sinusoidal.

3. A dielectric member according to claim 1, having an external ring on the outside of the member at the same level as said internal ring, said external ring bulging outwardly to compensate for the reduced thickness of glass next to the troughs of the corrugations in the internal ring.

4. A dielectric member according to claim 3, wherein said exterior ring is a toothed ring.

5. An electrical insulator including a dielectric member according to claim 1, wherein a link member is fixed inside the head of the dielectric member by means of a sealing material, and wherein said internal ring is also filled with sealing material.

6. An insulator according to claim 5, wherein the sealing material is a mortar of cement and fibers.

7. An insulator according to claim 5, wherein the sealing material is a mixture of cement and fibers.

* * * * *